US006223623B1

(12) United States Patent
Vance

(10) Patent No.: US 6,223,623 B1
(45) Date of Patent: May 1, 2001

(54) IDLE STOP MECHANISM FOR FOOT-OPERATED OUTBOARD MOTOR THROTTLE

(76) Inventor: David Ray Vance, 1266 Ardmore Hwy., Taft, TN (US) 38488

( * ) Notice: Subject to any disclaimer, the term of this patent is extended or adjusted under 35 U.S.C. 154(b) by 0 days.

(21) Appl. No.: 09/390,912

(22) Filed: Sep. 7, 1999

Related U.S. Application Data

(60) Provisional application No. 60/110,737, filed on Dec. 3, 1998.

(51) Int. Cl.[7] ..... G05G 1/14

(52) U.S. Cl. ..... 74/513; 74/526; 440/7; 114/153

(58) Field of Search ..... 74/526, 560, 513, 74/512, 480 B; 114/153; 440/6, 7

(56) References Cited

U.S. PATENT DOCUMENTS

| | | | | |
|---|---|---|---|---|
| 1,553,280 | * | 9/1925 | Wright | 74/526 X |
| 3,885,450 | * | 5/1975 | Tatum | 74/526 X |
| 4,432,390 | * | 2/1984 | Brazil | 74/526 X |
| 4,527,682 | * | 7/1985 | Gale | 74/526 X |
| 5,865,068 | * | 2/1999 | Huntley | 74/513 |
| 6,058,796 | * | 5/2000 | Huntley | 74/513 |

* cited by examiner

*Primary Examiner*—Mary Ann Green
(74) *Attorney, Agent, or Firm*—Joseph H. Beumer

(57) ABSTRACT

An idle stop for a certain type of motor boat throttles. The throttles involved have a pedal pivotally mounted on a base, an eccentric carried by the base and actuated by the pedal and a receptor mount connected to a side wall of the base. The idle stop includes a tab extending out from the pedal, the tab having a threaded aperture through which an adjustable bolt extends. A fixed edge on a side of the base provides a surface for the bolt to come into contact with, and thus limit rearward movement of the pedal.

11 Claims, 5 Drawing Sheets

IDLE STOP MECHANISM FOR FOOT-OPERATED OUTBOARD MOTOR THROTTLE

CROSS REFERENCE TO RELATED APPLICATION

This application claims the benefit of applicant's provisional application, Ser. No. 60/110,737, filed Dec. 3, 1998.

FIELD OF THE INVENTION

This invention relates to foot-operated motor boat throttles and more particularly to idle speed controls for such throttles.

BACKGROUND OF THE INVENTION

Foot-operated throttles are used in many boats, for example, in "Bass Boats," and other types of boats having high performance outboard motors. One approach to design of throttles for this purpose, which was developed some years ago for after-market installation, employed a pedal pivotally mounted on a base, an eccentric, also pivotally mounted on a side of the base, and actuated by the pedal, a receptor mount adjustably attached to the base and a spring biasing the eccentric toward the rear of the receptor mount. The receptor mount included one or more receptors for securing the outer sheath of a throttle-actuating cable, and the eccentric made provision for being connected to the inner, movable member of the cable. Control of maximum gas feed for these throttles was obtained by means of a stop extending upward from the base at its front end and engageable by the bottom of the pedal. No provision was made in these throttles for control of idle speed upon release of the pedal. This function was instead performed by idle speed mechanisms built into the carburetor.

Recent developments in outboard motor technology have made the prior approach to idle speed control obsolete. Outboard motors now include numerous electronic sensors which control complex fuel injection systems, ignition timing and the like. Precise controls over cable positions are now required for idle speed control.

An idle stop mechanism for foot-operated throttles is disclosed in U. S. Pat. No. 5,865,068, issued Feb. 2, 1999. This patent shows a limiter in the form of a bolt adjustably mounted on the receptor mount and aligned to come into contact with a limiter block provided on the eccentric. Installation of throttles having this stop mechanism requires two adjustments between the eccentric and the receptor mount; one for adjustment of the cable to proper position, and the other for positioning the limiter bolt of the idle stop mechanism. It would be desirable to provide for making adjustments to the stop mechanism independent of adjustments to cable position. This would simplify installation of the throttle and allow more flexibility with regard to the types or brands of motors for which the footoperated throttle may be used.

SUMMARY OF THE INVENTION

This invention is directed to an idle stop mechanism for foot-operated motor boat throttles which comprise a pedal pivotally mounted on side support walls of a base, an eccentric pivotally carried by the base and adapted for connection to the inner, movable member of a cable assembly, the pedal being slidably attached to the eccentric for actuation of the eccentric, a cable receptor mount attached to the back end of a side support wall, bias means for urging the eccentric toward the receptor mount, and the cable receptor adapted for securing the outer sheath of a cable. The idle stop mechanism for such throttles comprises a first stop member connected directly to the pedal and a second stop member integral with a side support wall of the throttle base, the two members being arranged to come into contact with one another at a selected limiting position, and at least one of the members including adjustment means.

In a preferred arrangement, a first stop member, in the form of an adjustable bolt is disposed in a threaded aperture of a laterally extending tab of the pedal and is aligned to come into contact with an edge of a fixed shoulder formed in a side wall of the base. Interaction between the eccentric and receptor mount is avoided in this approach so that adjustment for purposes of operation of the stop mechanism does not affect or interfere with cable positioning adjustments made between the eccentric and receptor mount.

DESCRIPTION OF THE PREFERRED EMBODIMENT

Figure 1:
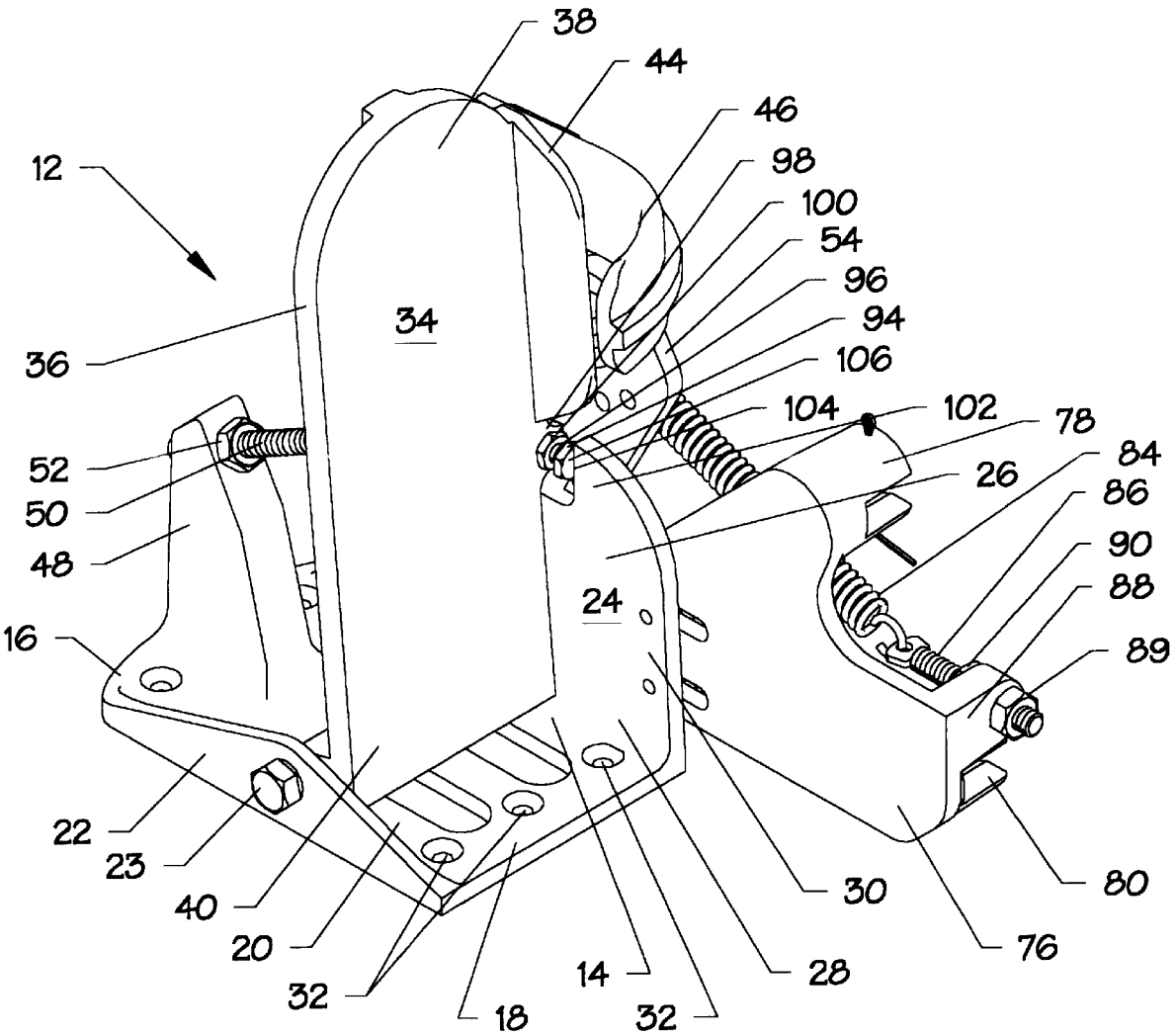
FIG. 1 is a perspective view showing a foot-operated throttle with an idle stop mechanism embodying the invention.

Referring to FIG. 1 of the drawings, a foot-operated throttle is shown generally at 12. The throttle mechanism is carried on a base 14 having a front end 16, a rear end 18, and bottom plate 20. A first side plate 22 and a second side plate 24 extend upward from bottom plate 20. Side plate 24 includes upper portion 26, a lower portion 28 and a connector portion 30. Mounting holes 32 are provided for attachment of the throttle to the deck of a boat or other supporting surface.

A pedal 34 having a sole plate 36, a toe 38 and a heel 40 is pivotally attached to the base 14 by a pin 23 passing through heel 40 of the pedal and side plates 22, 24 of the base. A foot guard 44 and a foot retainer 46 are attached to the pedal near the toe 38 to assist in maintaining the driver's foot in proper position.

A stanchion 48 extends upward from base 14 near its front end 16, providing a mount for an adjustable pedal stop 50, which may be locked in place by a lock nut 52. Pedal stop 50 limits the forward rotation of pedal 34, and thereby limits the amount of fuel fed to the engine and the resulting engine speed.

Figure 2:
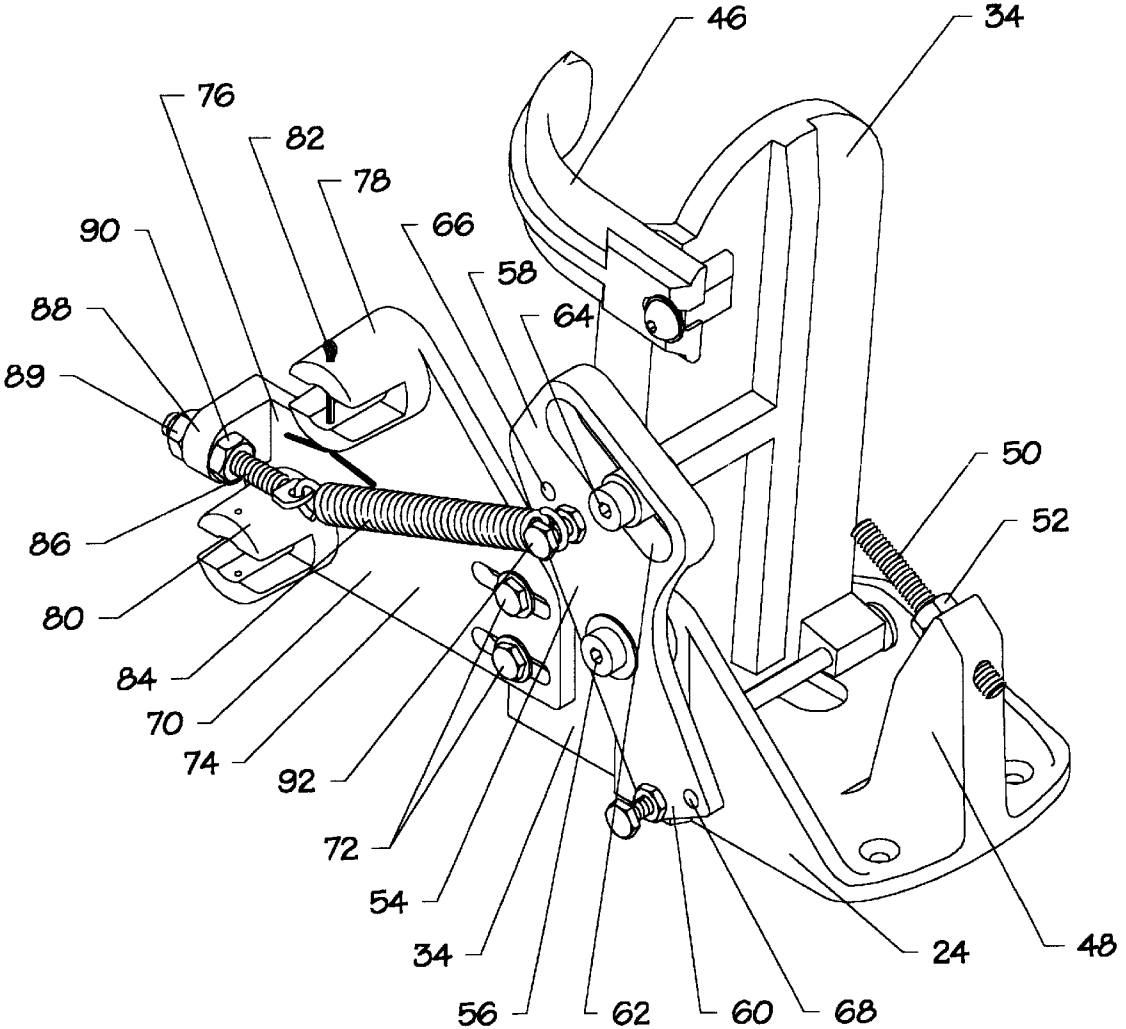
FIG. 2 is a perspective view of the device at FIG. 1 taken from a position on the opposite side.
Figure 3:
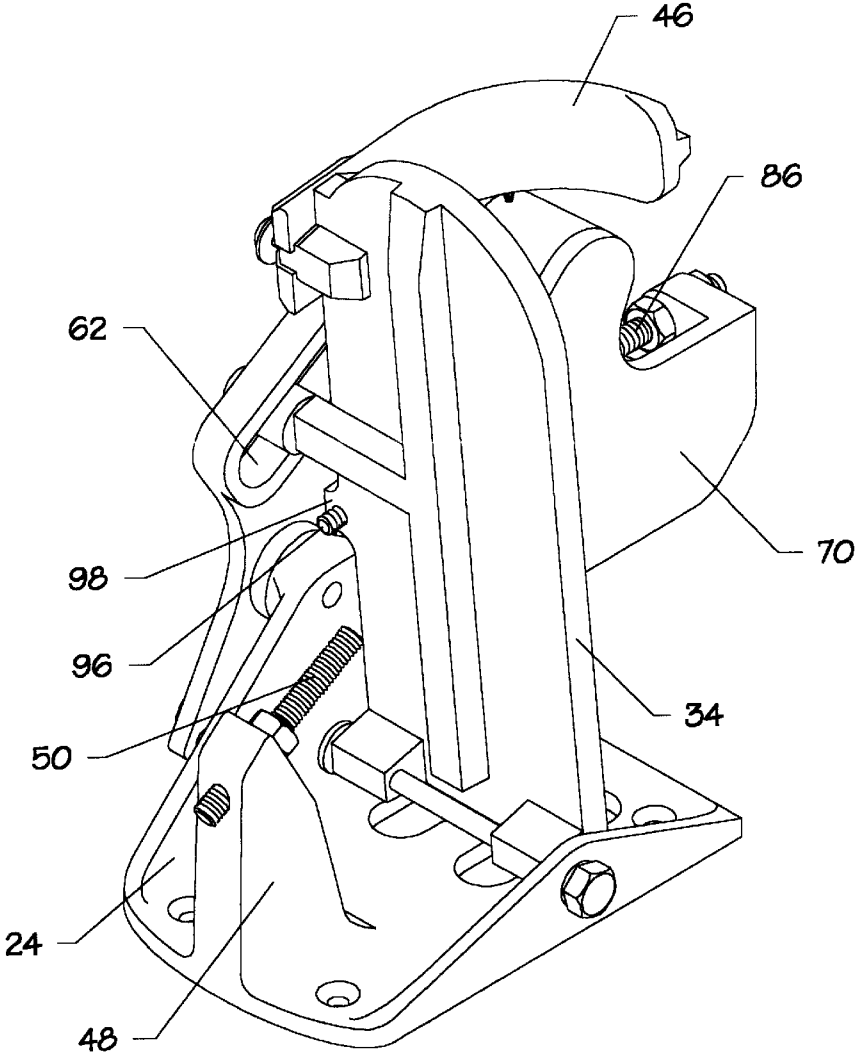
FIGS. 3 and 4 are perspective views of the device of FIG.1, taken from other positions.
Figure 4:
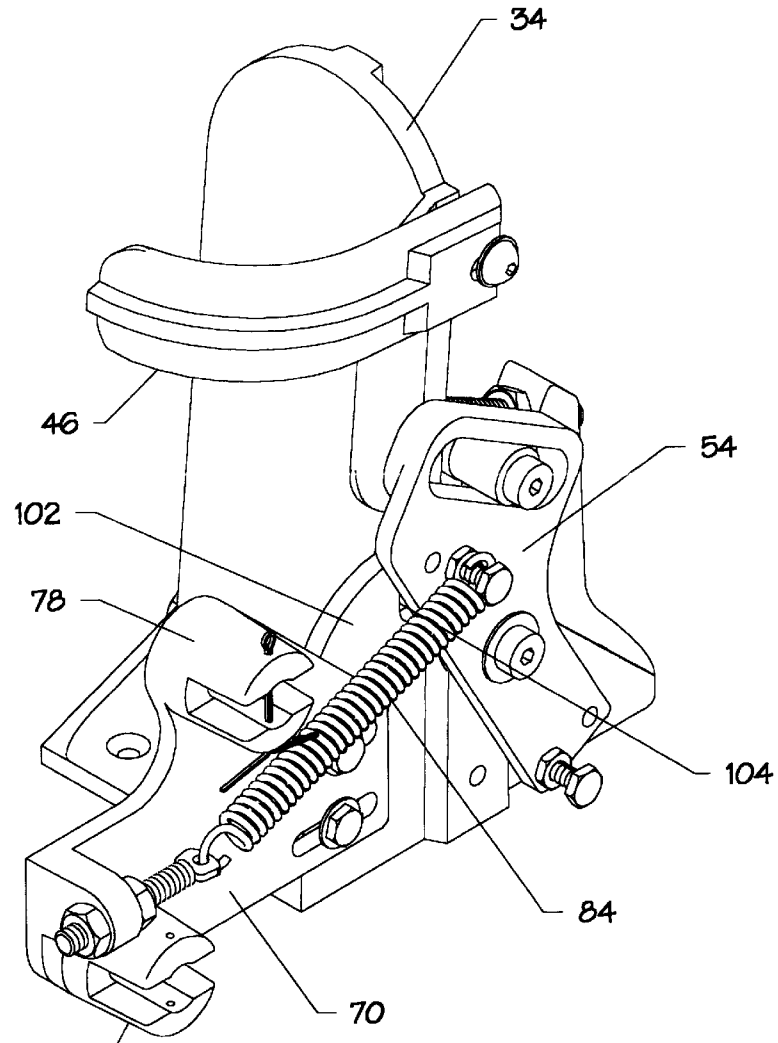

As best illustrated in FIG. 2, an eccentric 54 is pivotally attached to side wall 24 by a pivot 56. The eccentric 54 includes a top end 58 and bottom end 60. A slot 62 is formed in the eccentric 54 and extends from the top end 58 generally downwardly and forwardly toward the front end 16 of the base. An actuator 64 is attached to the pedal 34 intermediate the toe 38 and the heel 40. The actuator 64 is positioned within the slot 62 for rotation of the eccentric 54 about pivot 56 in response to rotation of the pedal 34 around pin 23.

A pull connector 66 and push connector 68 are formed adjacent the top end 58 and the bottom end 60, respectively, of the eccentric. Each of the connectors comprises a threaded hole which serves as a receptacle for attachment of the inner (moveable) portion of a throttle cable (not shown) to the eccentric 54. As is apparent from the drawing, the pull connector 66 actuates the moveable portion of a throttle cable by pulling motion of the eccentric, while the push connector actuates the moveable portion of a cable by pushing motion.

A receptor mount 70 is attached by mounting bolts 72 to the connector portion 34 of side plate 24. The receptor mount 70 has a forward section 74 and a rear section 76. The receptor mount 70 also includes a pull receptor 78 which is in general horizontal alignment with the pull connector 66, and a push receptor 80 which is in general horizontal alignment with the push connector 68. These receptors are configured for reception of barrel shaped connectors which are commonly used for mounting the stationary outer sheaths of throttle cables such as are used in modern boats. These connectors are typically held in place by cotter pins 82. This arrangement permits limited rotation of the barrel connectors in receptors such as 78 and 80. This limited rotation prevents bending of the throttle cable as the end of the inner (moveable) portion of the cable moves a small amount in a vertical direction. The connectors 66 and 68 do move vertically, to some degree, as the eccentric 54 rotates about the pivot 56. A spring 84 is adjustably connected at one end to the rear section 76 of receptor mount 70 by a spring adjuster 86. The spring adjuster 86 is threadedly attached to an internally threaded spring mount 88. The spring adjuster 86 is secured by nut 89 and is locked to prevent rotation by a spring lock nut 90. The distal end of the spring 84 is attached to the eccentric 54 by a spring bolt 92.

An idle stop 94 (FIG. 1) is disposed to restrain rearward motion of the pedal beyond a selected point and thus to maintain fuel flow above a desired minimum level during idling of the motor. The idle stop may take the form of a bolt 96 mounted on a laterally extending tab 98 of pedal 34. A threaded hole for receiving the bolt extends through the tab. Lock nut 100 is provided on bolt 96 to secure the bolt in position once it is adjusted. The bolt is aligned coplanar with side wall 24 so as to come into contact with the wall when the pedal moves backward. Upper portion 26 of the side wall 28 has defined therein a shoulder 102 with a vertically extending edge 104 arranged to be contacted by bolt head 106, upon movement of the pedal backward.

Although the invention is illustrated by an idle stop mechanism having a lateral tab extension of the pedal aligned with a fixed surface of a side wall of the base and an adjustable bolt mounted in the tab so as to make contact with the fixed surface, other arrangements which avoid contact or interaction of components of the idle stop mechanism with the receptor mount and/or the eccentric may be used. For example, an adjustment feature such as a moveable contact surface may be provided on the wall of the base instead of on the pedal extension.

Figures 5, 6:
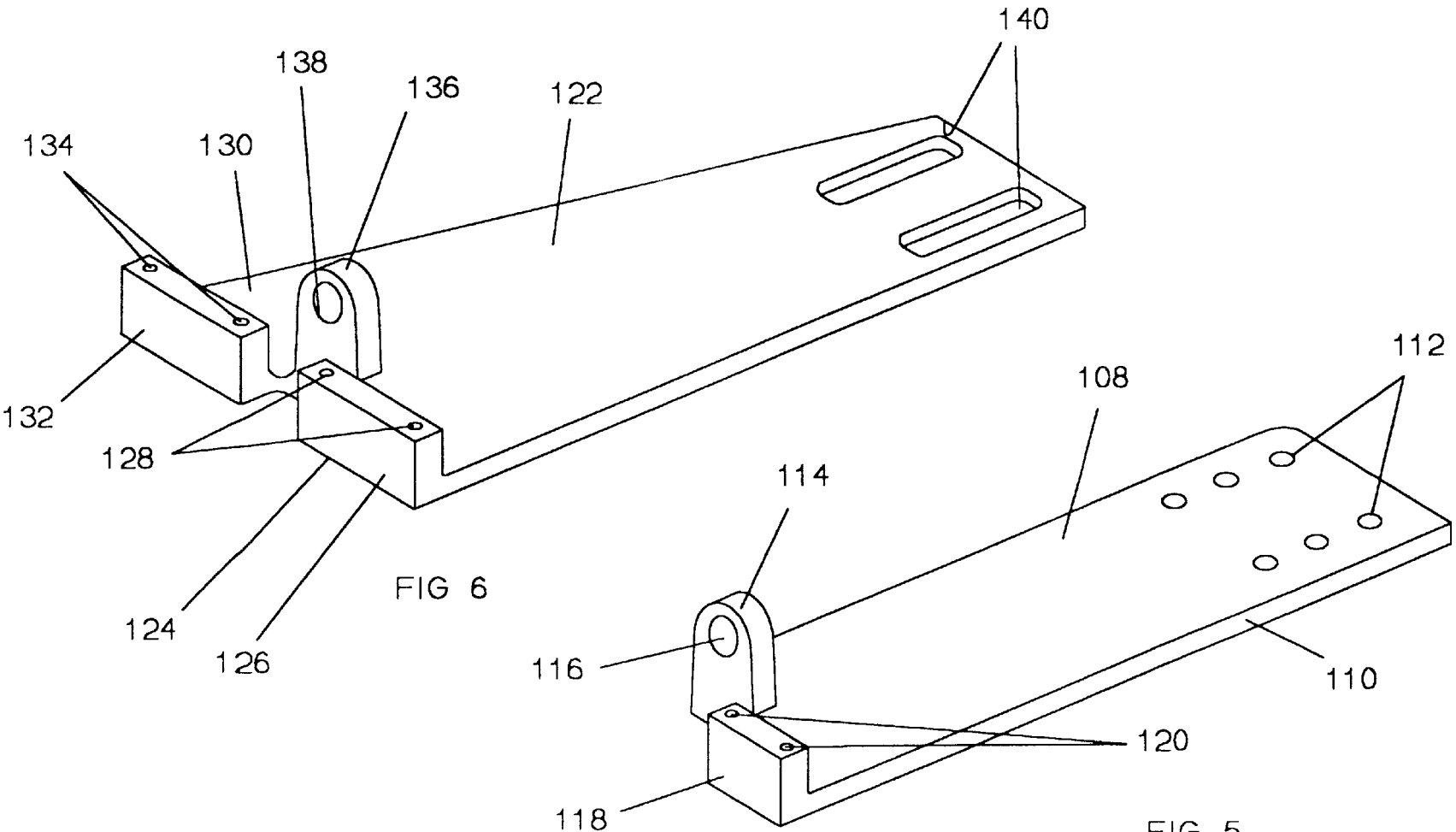
FIG. 5 is a perspective view of an alternative receptor mount for a push-type cable.
FIG. 6 is a perspective view of a receptor mount for pull-type and push-type cables.

FIGS. 5 and 6 show alternate forms of receptor mounts which may be used instead of the mount shown in the throttle control of FIGS. 1 through 4. Receptor mount 108 (FIG. 5) has a flat base 110 adapted to be secured to a side wall of the pedal base, attachment being made by bolts (not shown) extending through a selected pair of holes 112. Spring mount 114 extends outward perpendicularly from base 110, the mount having an internally threaded aperture 116 for receiving a spring adjuster bolt (not shown). A bracket 118 extends away from base 110 at a right angle, providing a cable receptor wherein a semicircular clamp member (not shown) may be attached by bolts received in hole 120. The outer sheath of a push type cable may be secured by this means.

FIG. 6 shows a receptor mount 122 which combines a push type receptor as shown in FIG. 5 with a pull-type connector in one device. The push connector portion 124 has a bracket 126 with bolt holes 128 for attachment of the outer sheath of a push type connector. The pull connector portion has a bracket 132 and bolt holes 134 for attachment of the outer sheath of a pull type cable. Spring adjuster mount 136 with a threaded aperture 138 for receiving a spring adjuster bolt (not shown) is disposed between the two portions so as to be available for use with either type of connector. Slots 140 are provided for adjustable attachment of the receptor mount to a side wall of the pedal base. These mounts provide further flexibility with regard to the different types or brands of motors for which the throttle control of this invention may be used.

Although the invention is described above by reference to specific embodiments, it is not to be understood as so limited but is limited only as stated by the appended claims.

What is claimed is:

1. A foot-operated throttle comprising:

a base having a bottom, a forward end, a back end and an opposed pair of side members extending upward from said bottom;

an eccentric pivotally attached to one of said side members and adapted for connection to a throttle cable;

a pedal having a heel end, a toe end, a base plate and a pair of side edges, said pedal having defined therein a journal extending across the pedal adjacent to said heel end and said pedal slidably attached to said eccentric and disposed for pivotal actuation of said eccentric in response to movement of said pedal;

a pivot pin having a first end and a second end, the said first end mounted on one of said side members and the said second end mounted on the other of said side members, the said pin extending through said journal and being disposed for enabling pivotal movement of said pedal;

a receptor mount attached to said one side member adjacent to said back end of said base, said mount carrying at least one receptor adapted for connection to a cable;

bias means disposed between said eccentric and said receptor mount for urging said eccentric toward said receptor mount;

and an idle stop mechanism for limiting rearward movement of said pedal wherein said idle stop mechanism comprises;

a first stop member located on a side edge area of said pedal and adapted for movement in response to movement of said pedal;

a second stop member comprising a contact surface defined in said one side member;

at least one of said stop members, including adjustment means and said stop members adapted to come into contact with one another at a selected position limiting backward movement of said pedal.

2. A foot-operated throttle as defined in claim 1, wherein said first stop member comprises a tab integral with said pedal and extending laterally outward.

3. A foot-operated throttle as defined in claim 2, wherein said first stop member further comprises a bolt adjustably mounted in a threaded aperture provided in said tab.

4. A foot-operated throttle as defined in claim 3 wherein said first stop member further comprises a lock nut engageable with said bolt.

5. A foot-operated throttle as defined in claim 3, wherein said second stop member comprises a vertically extending edge of said one side member, said vertically extending edge adapted to be contacted by said bolt.

6. A foot-operated throttle as defined in claim 5, wherein said vertically extending edge is provided in a shoulder located at an uppermost portion of said side member.

7. A foot-operated throttle as defined in claim 2, wherein said tab is located adjacent a half-way point of said pedal.

8. A foot-operated throttle as defined in claim 1, further comprising a stop member provided at the forward end of said base and adapted to be contacted with said pedal so as to limit forward motion of the pedal.

9. A foot-operated throttle as defined in claim 1, wherein said throttle is an outboard motor throttle.

10. A foot-operated throttle as defined in claim 1, wherein the location of said receptor mount in relation to said eccentric is adjustable for obtaining optimum cable positioning and said first and second stop members are adapted for adjustment with respect to one another independent of adjustments made between said eccentric and said receptor mount.

11. A foot-operated throttle comprising:

a base plate having a bottom, forward end, a back end and a pair of side members extending upward from said bottom and disposed perpendicular thereto;

an eccentric pivotally attached to one of said side members of said base and adapted for connection to a throttle cable;

a pedal having a heel end, a toe end, a pair of side edges, an upper face and a lower face, said pedal including a spaced-apart pair of lugs extending outward from said lower face adjacent to said heel end, said lugs each having an aperture extending therethrough, defining a journal for receiving a pivot pin, said pedal slidably attached to said eccentric and disposed for pivotal actuation of said eccentric in response to movement of said pedal:

a pivot pin having a first end and a second end, said first end supported by a first side member and said second end supported by a second side member whereby said pedal may undergo pivoting movement around said pin;

a receptor mount attached to said one side member adjacent to said back end of said base, said mount carrying at least one receptor adapted for connection to a cable;

bias means disposed between said eccentric and said receptor mount for urging said eccentric toward said receptor mount;

and an idle stop mechanism for limiting rearward movement of said pedal wherein said idle stop mechanism comprises;

a first stop member comprising a tab extending outward from one of said side edges of said pedal;

a second stop member comprising a contact surface defined in said side member of said base;

at least one of said stop members, including adjustment means and said stop members adapted to come into contact with one another at a selected position limiting backward movement of said pedal.

* * * * *